US005678623A

United States Patent [19]

Steen et al.

[11] Patent Number: 5,678,623

[45] Date of Patent: Oct. 21, 1997

[54] CASTING EQUIPMENT

[75] Inventors: Idar Kjetil Steen, Sunndalsøra; Bjarne Heggset, Frei; Torstein Sæther; Sverre Hanaset, both of Sunndalsøra; Karl Venås, Saupstad, all of Norway

[73] Assignee: Norsk Hydro A.S., Oslo, Norway

[21] Appl. No.: 630,206

[22] Filed: Apr. 10, 1996

[30] Foreign Application Priority Data

May 12, 1995 [NO] Norway ..... 951884

[51] Int. Cl.[6] ..... B22D 11/07; B22D 11/124

[52] U.S. Cl. ..... 164/268; 164/444; 164/472; 164/487

[58] Field of Search ..... 164/268, 444, 164/415, 487, 472, 475

[56] References Cited

U.S. PATENT DOCUMENTS

| | | | |
|---|---|---|---|
| 3,446,267 | 5/1969 | Gricol et al. | 164/268 |
| 4,598,763 | 7/1986 | Wagstaff et al. | 164/268 X |
| 4,947,925 | 8/1990 | Wagstaff et al. | 164/444 X |
| 4,962,807 | 10/1990 | Næss et al. | 164/444 |
| 5,170,838 | 12/1992 | Theler et al. | 164/472 X |
| 5,325,910 | 7/1994 | Schneider et al. | 164/268 X |

FOREIGN PATENT DOCUMENTS

| | | | |
|---|---|---|---|
| 0167056 | 1/1986 | European Pat. Off. | 164/268 |
| 57-39061 | 3/1982 | Japan | 164/268 |
| 652325 | 11/1985 | Switzerland | 164/472 |
| 665575 | 5/1988 | Switzerland | 164/268 |

*Primary Examiner*—J. Reed Batten, Jr.
*Attorney, Agent, or Firm*—Wenderoth Lind & Ponack

[57] ABSTRACT

Casting equipment for continuous or semi-continuous direct chill casting of metals, in particular the casting of billets or ingots of aluminum, has a mold cavity (4) with an inlet (2) that is upwardly open, an intermediate, inwardly facing and heat insulated overhang or hot-top (8), and an outlet with a vertically movable supporting device (5). A slit (10) supplies water to cool the molted metal. The wall in the mold cavity is wholly or partly constituted by a permeable material, whereby oil and/or gas are supplied through the permeable material to form an oil and/or gas layer between the metal and the wall of the mold to prevent the metal from coming into direct contact with the wall of the mold. The oil and gas are supplied separately through two independent, and, by means of a sealing element (14) or the like, physically separated rings or wall elements (12, 13). The upper wall element (12) for the supply of oil, is arranged above the area where the freezing front of the metal is located, while the lower wall element for the supply of gas is arranged directly opposite to the freezing front (19) of the metal (11) and extends from a lower part of the mold cavity and beyond the contact point between the metal and the mold wall.

19 Claims, 1 Drawing Sheet

CASTING EQUIPMENT

BACKGROUND OF THE INVENTION

The present invention relates to casting equipment for continuous or semi-continuous direct chill (DC) casting of metals, particularly casting of ingots or billets of aluminium. Such equipment comprises a mould cavity with an inwardly facing hot top inlet that is heat insulated and adapted for the supply of melted metal, and an open outlet provided with means for the supply of water for direct cooling of the melted metal. Walls of the mould cavity are partly or wholly constituted by a permeable material, whereby oil and/or gas may be supplied through the permeable material to provide a layer of oil- and/or gas between the metal and the mould wall, to avoid the metal coming into direct contact with the wall.

Supplying oil and/or gas to the mould cavity of a casting mould, as mentioned above, is shown in several publications. Among others, the U.S. Pat. No. 4,157,728(Showa) shows DC casting equipment where oil and gas are supplied simultaneously through narrow slits arranged in the mould wall, and where the wall is made of a graphite material. The supply being caused by pressure differences and capillary effect, the fluids (oil and gas) will in addition be supplied partly through the graphite material in the zones close to the slits. Meanwhile, when put into practice, it is observed that the slits that supply oil and gas may easily become blocked by metal, especially in the start-up phase. Besides, the gas pressure is difficult to control in relation to the slits, as it easily may become higher than the metal static pressure in the chill (mould cavity) and thereby cause unfavourable conditions such as bubble and oxide formation during the casting process, resulting in an uneven, in consistent surface of the cast product. Performing casting operations with such equipment as shown in U.S. Pat. No. 4,157,728 will not sustain satisfactory results with respect to reproduction and quality of the cast products.

An analogous situation will be present when performing casting operations with the equipment as described in U.S. Pat. No. 4,598,763 (Wagstaff). Instead of using slits, the oil and the gas is supplied to the mould cavity by means of a graphite ring or a graphite section. The graphite ring is arranged in the mould cavity, and in the region thereof where the metal freezes during the casting operation. The purpose of supplying oil and gas in this region through the one and the same ring is to secure sufficient lubrication together with having the gas act to force the metal away from the graphite ring. However, one severe disadvantage involved with this solution is that the oil supplied in the upper area of the ring tends to block the pores in the graphite, resulting in that the gas supplying area becomes narrower and takes place at a lower level in the ring. Simultaneously, a decrease in the oil supply will occur. This blockage is partly caused by small particles contained in the oil that is captured by the pores (the graphite acts as a filter), and partly by carbonization of oil in the graphite caused by the high temperatures in the oil containing area of the ring where the metal freezes. In an effort to counteract the blocking effect of the pores, it is common practice to maintain the supply of gas between distinctive casting operations. However, this will result in a higher gas consumption.

The use of graphite in casting moulds is, in addition, known from GB patent application no. 2,014,487. According to this, gas is supplied through a porous ring that serves as the wall constituting element in the mould cavity, as oil is dripped downwards into the mould cavity between the floating metal and the gas membrane. This solution implies an unsatisfactory distribution of the lubrication film and a large consumption of oil, as in the U.S. Pat. No. 4,157,728 (Showa).

SUMMARY OF THE INVENTION

According to the present invention there is provided DC casting equipment for casting metals, where the above mentioned disadvantages related to the known solutions are eliminated or substantially reduced.

The invention is characterized in that the oil and the gas are supplied separately through two independent and physically separated rings or wall elements, that may be separated by sealing elements or similar devices. An upper wall element adapted for the supply of oil is arranged above the region where the freezing front of the metal is located, whereas a lower wall element adapted for the supply of gas is arranged directly opposite to the freezing front of the metal and extends from the lower part of the mould cavity and beyond the contact point between the metal and the mould wall.

With this solution the following advantages are achieved:

The supply of oil and gas will not be mutually influenced in the course of time, thus securing stable conditions in the chilling process that result in ingots having consistent quality with respect to both metallurgical properties and to surface quality.

Maintenance costs of the chills will be at a very low level.

Adjustments of the gas or oil quantities while performing casting operations or between distinctive casting operations, are only performed in very particular cases.

As the oil is supplied in a region that will not be in contact with the liquid metal while performing the casting operations, trouble with carbonizing of the oil in the oil supplying element is eliminated.

The oil element may be exchanged without interference with the gas element, and vice versa.

The elements for the supply of the two fluids may be optimized in a mutually independent manner to sustain the best conditions (for instance uniform distribution of gas and oil along the periphery of the mould) when performing the casting operations.

Decreased consumption of gas, as the supply of gas between distinctive casting operations will not be necessary.

BRIEF DESCRIPTION OF THE DRAWINGS

In the following, the invention is described in detail with reference to drawings that illustrate an embodiment thereof, where.

DETAILED DESCRIPTION OF THE PREFERRED EMBODIMENTS

Figure 1:
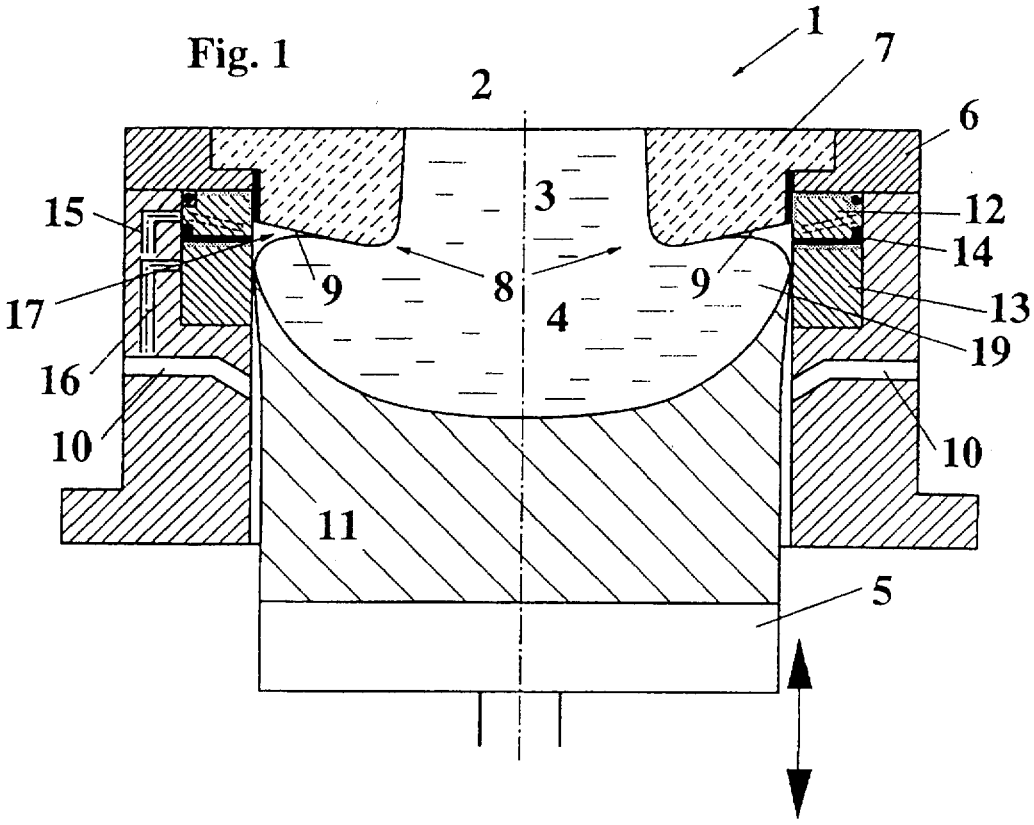
FIG. 1 shows in a schematically manner a vertical cut through a casting mould for continuous or semi-continuous (DC) casting of metals where the mould is provided with elements for the supply of oil and gas, according to the invention.

As mentioned, FIG. 1 shows in a schematically manner a vertical cut through a casting mould 1 for continuous or semi-continuous (DC) casting of metals. The casting mould 1 may be adapted for casting ingots of square or rectangular sections, or billets of circular or oval sections.

Due to the large dimensions of the ingots, there will only be a small number of casting moulds as shown in FIG. 1 in conjunction with each casting installation. When producing billets, however, which have significantly smaller dimensions than the ingots, it is rather common to arrange plural moulds in a joint frame structure together with a joint reservoir for the supply of molten metal, where the reservoir is mounted above the moulds (not shown). In this connection it should be stated that the use of the expression "casting mould" in the succeeding, may implicate any water chilled, continuous or semi-continuous casting equipment of any dimension.

FIG. 1 shows as mentioned a schematic vertical cut through a casting mould 1 for continuous or semi-continuous water-chilled casting of metals. The casting mould comprises an upper inlet section 2 having an opening that faces upwards, an inwardly facing central section 3 and a lower mould cavity or chill 4 that is open downwards. At the downwardly facing side of the mould cavity 4, that is to say at the outlet of the casting mould, there is arranged a supporting means or bottom part 5 that is movable in the vertical direction by means of a piston cylinder device or the like (not further shown). The supporting means is brought into close abutment with the outlet of the casting mould at the begining of the casting cycle.

The casting mould comprises an outer collar 6, by preference made of aluminium or steel, where oil- and gas element 12, 13 are fixed by means of a clamping ring. The inlet section of the casting mould is provided with a refractory, insulating material 7. The casting mould is fixed to a supporting frame structure, not further shown in the drawing.

The refractory material 7 in the casting mould forms the wall in the central section 3 that commonly is named as "hot-top 8". The hot-top 8 has a narrow passage in the cavity of the casting mould in the direction of the flow, and provides an overhang 9 at the inlet of the mould cavity 4.

At the lower part of the mould cavity there is arranged a water slit 10, for the supply of water, that extends along the periphery of the mould cavity and that is connected to a reservoir of water in conjunction with the casting mould (not further shown).

While performing casting operations with this kind of equipment, liquid metal is supplied from the top of the mould through the inlet 2 thereof, at the same time as the supporting means 5 is moved downwardly and a cast metal 11 surface is directly chilled by water supplied through the water slit 10. The direct chilling of the metal 11 by means of water has given the name to the process: "Direct Chill (DC) Casting".

One special feature involved in the present invention is that the wall in the mould cavity 4, immediately below the hot-top 8, is constituted by two permeable, separate rings or wall elements 12, 13, that are mutually separated by the means of a physical restriction, such as a sealing element 14 or the like. The upper wall element 12 is adapted for the supply of oil and is arranged above the region where a freezing front 19 of the metal is located, while the lower wall element 13 is adapted for the supply of gas and is arranged immediately opposite to the freezing front 19 of the metal and extends from the lower part of the mould cavity and over the contact point between the metal and the mould wall. Oil and gas are supplied to the casting cavity 4 through the respective wall elements 12 and 13, from a pump/reservoir (not shown) through the bores or channels 15, 16.

The purpose of the restriction 14, which may comprise a metal packing or any non porous material, an impregnating agent or the like, is to restrict the oil from being forced from the upper oil supplying element 12 to the lower gas supplying element 13 or vice versa. Another important feature of the invention is that the oil supplying element 12 should be positioned above the meniscus of the metal (the metal surface) in the mould cavity, that is to say in the area below the hot-top Where a gas pillow 17 is formed during the casting operation. The reason for doing this is that the oil supplying element will then not be allowed to come into contact with the hot metal, avoiding carbonizing of the oil in the element. Thus, the condition will be voided where the oil supplying element gets blocked as a result of carbonization. Besides, as the oil supplying element 12 will not be directly exposed to the high temperature of the metal, there may be employed in this element permeable materials that are designed for lower temperatures, for instance sintered metals such as sintered bronze. Furthermore, as concerns the supply of oil, it is a substantial feature that the oil is supplied in small quantities and is evenly distributed along the periphery of the wall of the mould cavity, such that there is built up a thin oil layer on the surface of the gas supplying element or -ring 13 arranged below the element 12.

Figure 2:
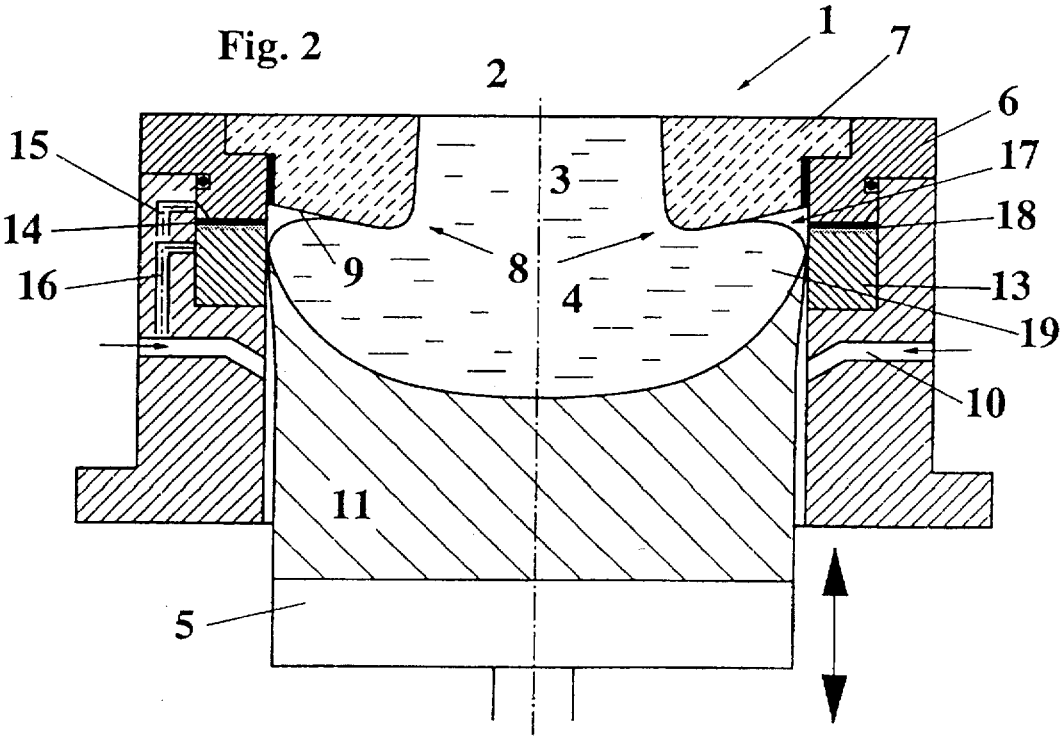
FIG. 2 shows the same mould as in FIG. 1, where elements with alternative designs are applied, according to the invention.

As an alternative to the use of a porous material such as a sintered material, graphite or a ceramic material, the oil supplying element may be provided with a slit 18 filled with a mineral/ceramic fiber paper, for instance Fiberfrax®, as shown in FIG. 2.

Furthermore, the gas supplying ring 13 is obliged to be made out of a permeable material that is able to sustain the melting temperature of the metal. Preferably, this ring or element may be made out of a porous graphite or a porous ceramic material.

We claim:

1. A casting arrangement comprising:

a casting mould having a wall defining a mould cavity, said mould cavity having an upwardly facing inlet, an outlet, and an intermediate inwardly facing insulated overhang, whereby when molten metal is cast in said casting mould, molten metal enters said inlet, goes through said intermediate inwardly facing insulated overhang and to said outlet, the molten metal having a contact point with said wall of said casting mould;

a vertically movable support at said outlet for supporting the molten metal that is cast;

means for supplying water into said mould cavity for cooling molten metal being cast such that a freezing front is formed in the molten metal being cast at a freezing front point in said mould cavity;

an oil supply wall element forming a part of said wall of said casting mould and located above said freezing front point;

a gas supply wall element forming a part of said wall of said casting mould, located below said oil supply wall element and directly opposite to said freezing front point, and extending upward to a point above said contact point of the molten metal with said wall of said casting mould, wherein said oil supply element and said gas supply element are physically separate; and means for sealing said oil supply element from said gas supply element.

2. The arrangement of claim 1, wherein said oil supply element comprises a material selected from the group consisting of a porous metallic material, graphite and a porous ceramic material.

3. The arrangement of claim 1, wherein said oil supply element comprises a slit filled with heat resistant fiber paper.

4. The arrangement of claim 1, wherein said gas supply element comprises a material selected from the group consisting of graphite and a porous ceramic material.

5. The arrangement of claim 2, wherein said gas supply element comprises a material selected from the group consisting of graphite and a porous ceramic material.

6. The arrangement of claim 3, wherein said gas supply element comprises a material selected from the group consisting of graphite and a porous ceramic material.

7. The arrangement of claim 1, wherein said means for sealing comprises a packing that is made of a material that is non-porous and heat resistant.

8. The arrangement of claim 1, wherein said packing is made of a metal material.

9. The arrangement of claim 1, wherein said means for sealing comprises a layer between said oil and gas supply elements that comprise an impregnating agent.

10. A casting arrangement comprising:

a casting mould having a mould wall defining a mould cavity, said casting mould having an inlet to said mould cavity and an outlet from said mould cavity, and said casting mould further comprising an overhang portion between said inlet and said outlet defining a passage that is narrower than said mould cavity;

a vertically movable support disposed at said outlet for supporting metal cast by said casting mould;

a water channel extending through said mould wall to said mould cavity, whereby when molten metal is cast through said mould cavity, water can be supplied to said mould cavity to chill the molten metal, thus creating a freezing front of the molten metal;

an oil supply element forming a part of said mould wall of said casting mould, said oil supply wall being located above a point along the mould cavity corresponding to an intended freezing front point;

a gas supply element forming a part of said wall of said casting mould located below said oil supply wall element and directly opposite to the intended freezing front point, and extending upward to a point above an intended point of contact between the molten metal and said wall of said casting mould, wherein said oil supply element and said gas supply element are physically separate elements; and a seal between said oil supply element and said gas supply element.

11. The casting arrangement of claim 10, wherein oil and gas supply channels extend to said oil and gas supply elements, respectively.

12. The casting arrangement of claim 10, wherein at least one of said oil and gas supply elements comprises an annular member.

13. The casting arrangement of claim 10, wherein said overhang portion is defined by a refractory member disposed at said inlet, said refractory member abutting said oil supply element.

14. The casting arrangement of claim 10, wherein said oil supply wall element comprises a material selected from the group consisting of a porous metallic material, graphite and a porous ceramic material.

15. The arrangement of claim 10, wherein said oil supply element comprises a slit filled with heat resistant fiber paper.

16. The arrangement of claim 10, wherein said gas supply element comprises a material selected from the group consisting of graphite and a porous ceramic material.

17. The arrangement of claim 10, wherein said seal comprises a packing that is made of a material that is non-porous and heat resistant.

18. The arrangement of claim 17, wherein said packing is made of a metal material.

19. The arrangement of claim 10, wherein said seal comprises a layer between said oil and gas supply elements that comprises an impregnating agent.

* * * * *